US006769570B2

(12) United States Patent
Logan

(10) Patent No.: US 6,769,570 B2
(45) Date of Patent: Aug. 3, 2004

(54) MEDICATION DOSAGE CONTAINER

(75) Inventor: Maurus Logan, Elizabeth, NJ (US)

(73) Assignee: Medcount Systems, L.L.C., Elizabeth, NJ (US)

( * ) Notice: Subject to any disclaimer, the term of this patent is extended or adjusted under 35 U.S.C. 154(b) by 0 days.

(21) Appl. No.: 10/124,785

(22) Filed: Apr. 18, 2002

(65) Prior Publication Data

US 2003/0196927 A1 Oct. 23, 2003

(51) Int. Cl.[7] ..... A24F 15/04
(52) U.S. Cl. ..... 221/188; 221/288; 221/186
(58) Field of Search ..... 221/188, 186, 221/286, 287, 288; 206/538, 540; 220/501, 527, 529

(56) References Cited

U.S. PATENT DOCUMENTS

| | | | | | |
|---|---|---|---|---|---|
| 3,601,250 | A | * | 8/1971 | Merila | 206/540 |
| 3,931,891 | A | * | 1/1976 | Peppler | 206/538 |
| 4,475,654 | A | * | 10/1984 | Fruchter | 206/538 |
| 6,302,295 | B1 | * | 10/2001 | Weisman | 221/188 |
| 6,347,705 | B1 | * | 2/2002 | Futrell | 206/534 |

* cited by examiner

*Primary Examiner*—Donald P. Walsh
*Assistant Examiner*—Kaitlin Joerger
(74) *Attorney, Agent, or Firm*—James J. Daley

(57) ABSTRACT

A medicine container comprises an upstanding body having an open mouth and a hollow interior bounded by a sidewall and a separator secured in the body and defining upper and lower compartments, the upper compartment opening into the body open mouth, the lower compartment being accessible while the separator is secured in the body.

26 Claims, 10 Drawing Sheets

MEDICATION DOSAGE CONTAINER

FIELD OF THE INVENTION

This invention relates generally to medication dosage control and pertains more particularly to a medication dosage container having facility for dosage control.

BACKGROUND OF THE INVENTION

From applicant's perspective, which is widely that of the pharmacological community, while the primary drug problem facing society is illicit drug usage, a quite serious secondary drug problem lies in medication usage errors. This problem is heightened when one considers that the vast majority of medication users are elderly and may have vision and memory difficulties and that many thereof are required to take different medicines with different dosages over different time periods.

The discipline associated with dispensing of medication to a patient in a hospital ("in-patient" medication dispensing) lessens the secondary drug problem. A dispensing dolly is loaded, per patient and per time of distribution with the involved medications and patient identification. A nurse moves the dolly from patient to patient and dispenses the required medication. The dolly is then replenished with medication for the next time of distribution and the dispensing recurs at such next time.

The prior art evidences various approaches seen to address the secondary drug problem for patients who are not beneficiaries of "in-patient" medication dispensing.

In U.S. Pat. No. 4,460,106, a pill receptacle is provided containing a plurality of pills of the same type of medication and a dispensing device is attached to the open top of the receptacle, closing the same. The dispensing device includes plural compartments and transfer apparatus for advancing a single pill from the pill receptacle through the compartments for delivery to a medicant. A similar approach is taken in U.S. Pat. No. 3,730,387.

The referenced patents are seen as providing a single, portable structure adapted to contain medicine for plural given dosages and to selectively and repetitively dispense a given dosage, thus partly emulating the "in-patient" regimen. However, the structures provided are seen as relatively complex, expensive to manufacture and not adapted for use with commercial medicinal dosage containers.

In his assessing of present commercially sold medication dosage devices, applicant has confronted a still further approach, depicted in FIGS. 29 and 30 hereof in its component parts relevant to the subject invention. Here, an upstanding cylindrical outer container 300 defines an interior hollow having a lower portion 302 and an upper portion 304. A ledge 306 is formed between the upper and lower portions. An insert/separator 308 for the container has a floor 310 dimensioned to be supported by ledge 306 and a cylindrical sidewall 312 integral with floor 310 and extending to open mouth 314. Cap 316 serves as a closure member for the depicted commercially-available dosage device.

When inserted in container 300, insert 308 divides the container into an upper compartment defined by the interior of the insert, i.e., the volume bounded by floor 310 and sidewall 312, and a lower compartment defined by the container volume below the insert and ledge 306. The upper compartment may be filled with a given medication dosage, e.g., a one-day supply, and the lower compartment may be filled with a multiple-day supply, e.g., a week's supply. Use of the device is understood to involve a medical care provider, or the drug user himself/herself, to remove the insert, to remove a one-day dosage supply from the lower compartment, to place the one-day dosage supply into the insert and to place the insert in the container and then to apply the closure member to the container.

Advantage attends this commercial device in that simple inspection of the contents of the insert will enable the medical care provider, or the drug user, to ascertain whether the one-day supply has been ingested. The device is also simpler than the above-discussed patented devices. There remains the disadvantage, however, that the structure is not adapted for use with commercial medicinal dosage containers. Thus, commercial medicinal dosage containers are molded about a pin which defines a continuous interior sidewall, typically tapered to facilitate removal of the formed container from the forming pin. No structure akin to ledge 306, requisite for supporting insert 308, is present in the commercial dosage containers.

U.S Pat. No. 4,420,083 also discloses a medicine container which has compartments for daily and total supply of pills. In this container, an elongate, flat insert is wedged against the interior cylindrical sidewall of the container and extends from the floor of the container to its open mouth. The container is thus provided with vertically extending first and second compartments. The total dosage is placed in the first compartment and a daily dosage is placed in the second compartment and a closure member (cap) is applied to the container.

In patient or caretaker use of the container, the cap is removed from the container. Since the daily dosage is on the floor of the container second compartment, the container need be inverted to obtain the daily dosage. In order to prevent escape of pills from the first compartment, it is necessary to deflect the upper portion of the insert to close the first compartment. Further, to preclude a patient or caretaker from mistakenly deflecting the insert to close the second compartment and take pills from the first compartment, radially, inwardly-directed stops are provided at the top of the container second compartment, precluding such mistake. When the daily dosage is fully taken, the patient or caretaker removes a further daily dosage from the first compartment and places the same in the second compartment.

Need for the stops precludes use of commercial medicinal dosage containers.

U.S Pat. No. 4,475,654 also discloses a medicine container which has compartments for daily and total supply of pills. In this device, a container which is of commercial medicinal dosage type is used in combination with a closure member which is formed with an accessible compartment for storage of a daily dosage. The total pill supply is placed in the container. A daily dosage is placed in the closure member compartment and then the closure member is applied to the container. Disadvantage is seen in the need for the specialized closure member structure in place of the closure members used with containers of commercial medicinal dosage type.

In contrast to the foregoing plural compartment devices, wherein the smaller (daily dosage) compartment is refillable, the smaller medicine dosage container compartment shown in U.S. Pat. No. 6,347,705 B1 is for single use. In this arrangement, a separator is removably secured in a container, the separator having a bottom disc member which has a sliding or light compressive fit with the interior wall of the container, providing a compartment thereabove and delineating a container compartment therebelow. A thin stem extends upwardly from the disc periphery. The separator and disc bear indications of patient, type of medication and issuing pharmacy and its mailing address.

In use of this device, a supply of medication is placed in the container, the separator disc is inserted atop the supply of medication and a further supply of medication is placed atop the separator disc. When the supply of medication atop the separator disc is depleted, the stem is pulled out of the container, removing the separator disc, which is then mailed to the pharmacy to reorder the medication. The purpose of the device is to insure continuance of medication, i.e., use of the medication remaining in the container after separator disc removal, during the reorder period and receipt period.

SUMMARY OF THE INVENTION

The present invention has as its primary object to provide a medication dosage container and dispenser of quite simple and economical nature.

It is a more particular object of the present invention to adapt commercial dosage containers with facility for separately containing medication dosages for administration over different time periods.

In one aspect, the invention provides a medicine container, comprising an upstanding body having an open mouth and a hollow interior bounded by a sidewall and a separator secured in the body and defining upper and lower compartments, the upper compartment opening into the body open mouth, the lower compartment being accessible while the separator is secured in the body.

In another aspect, the invention provides a medicine container comprising an upstanding body having an open mouth and a hollow interior bounded by a sidewall and a separator seated in the body and defining upper and lower compartments, a perimeter of the upper compartment being formed successively by the body sidewall and the separator, the perimeter preferably being of D-shape.

In a further aspect, the invention provides a medicine container, comprising an upstanding body having an open mouth and a hollow interior, the body defining an interior tapered surface bounding the hollow interior and a separator seated in the body and defining upper and lower compartments, the separator having an exterior tapered sidewall having the same taper angle as the body interior surface.

The foregoing and other features of the invention will be further understood from the ensuing detailed description of preferred embodiments and practices and from the drawings, wherein like reference numerals identify like components throughout.

DETAILED DESCRIPTION OF PREFERRED EMBODIMENTS AND PRACTICES

Figure 1:
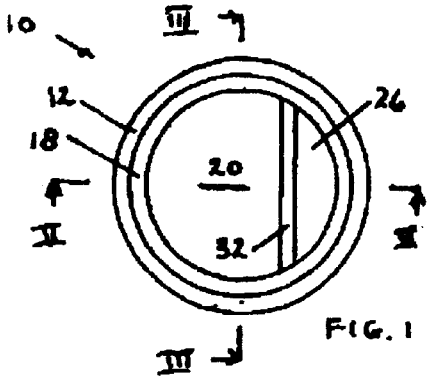
FIG. 1 is a top plan view of a first embodiment of a medication container and dispenser in accordance with the invention.
Figure 3:
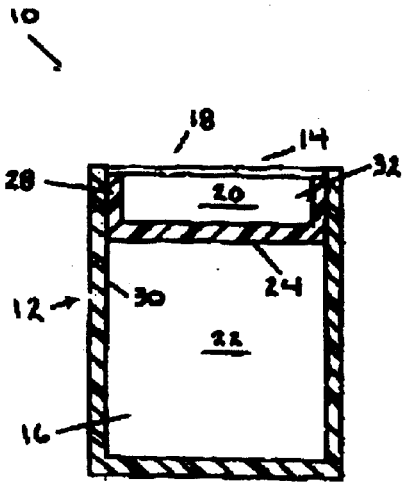
FIG. 3 is a sectional elevation of the FIG. 1 container and dispenser as would be seen from plane III—III of FIG. 1.
Figure 2:
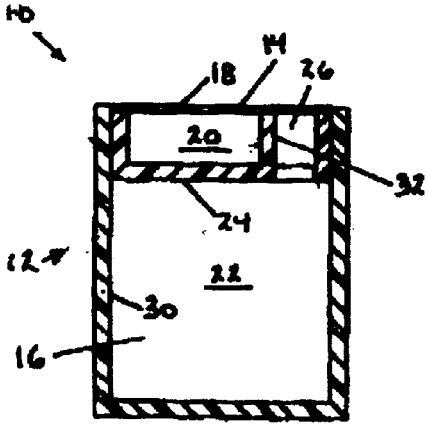
FIG. 2 is a sectional elevation of the FIG. 1 container and dispenser as would be seen from plane II—II of FIG. 1.

Referring to FIGS. 1–3, medicine container 10 comprises upstanding body 12 having open mouth 14 and hollow interior 16. Separator 18 is seated in body 12 and defines upper and lower compartments, respectively indicated at 20 and 22.

While body 12 may have various cross-sections, body 12 of FIGS. 1–3 is shown to be circular in cross-section. Separator 18 defines a floor 24 for upper compartment 20 and a passage 26 opening into lower compartment 22. Separator 18 has upstanding cylindrical sidewall 28 contiguous with interior sidewall 30 of body 12 and is suitably secured therewith, e.g., by an adhesive, whereby separator is fixedly seated in body 12.

Separator floor 24 extends partly across the cross-section of separator 18 and passage 26 is disposed between the end of separator floor 24 and separator sidewall 28.

More particularly, separator 18 further includes upstanding interior sidewall 32 bounding upper compartment 20 and extending upwardly jointly with the separator sidewall 28 from the interior end of separator floor 24.

In use of the embodiment of FIGS. 1–3, a multiple time period dosage, e.g., a one-week's supply, of a given medication is inserted into lower compartment 22 through passage 26. A lesser time period dosage, e.g., a one-day's supply, of the given medication is now withdrawn from lower compartment and is inserted into upper compartment 20. A closure member is thereupon applied to the container and the container is thus set for a one-week supply of medication.

The container bears a label with printed indication of the periodicity of taking and dosage to be contained in the upper compartment, e.g., four pills to be taken one each six hours.

The patient or patient caretaker administers one pill by removing the closure member and withdrawing such one pill from upper compartment 20 and replacing the closure member. In the example under discussion, this procedure is repeated at six hour intervals. If the medication has been properly administered, upper compartment 20 will be empty at the close of the twenty-four period. If medication is present in upper compartment 20 at the close of the twenty-four period, it is apparent to the patient or patient caretaker that a medication administration error has occurred and correction may be effected by administrating the remaining contents of the upper compartment to the patient.

Assuming either the propriety of administration of the medication or such correction in administration thereof, the now-open container is inverted and a second one-day medication dosage is withdrawn from lower compartment 22 through passage 26 and inserted in upper compartment 20. The closure member is reapplied, whereby the container is readied for the second day of medication dispensing. It is to be appreciated that, with the closure member applied to the container, the container may be inverted without transfer of medication from lower compartment 22 to upper compartment 20.

Figure 30:
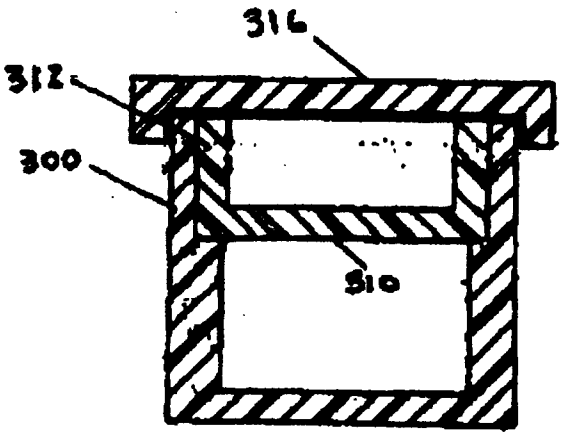
FIG. 30 (PRIOR ART)
FIG. 30 is an exploded view, centrally-sectioned of the components of the FIG. 29 container and dispenser.
Figure 29:
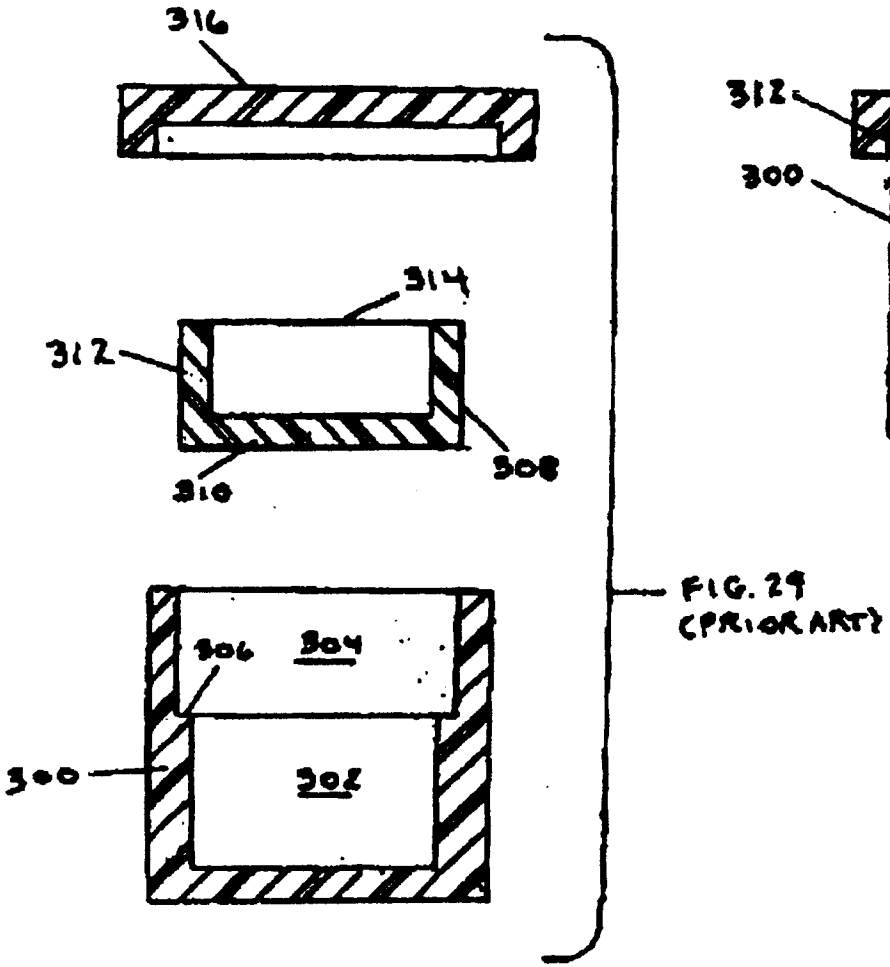
FIG. 29 (PRIOR ART)
FIG. 29 is a centrally-sectioned view of a known prior art medication dosage container and dispenser.

Differences of consequence exist as between the prior art device of FIGS. 29 and 30 and the device of FIGS. 1–3. It will thus be appreciated that both of the compartments are accessible upon removal of the closure member. Thus, separator 18 remains with the container at all times, unlike the prior art separator, which need be removed from the container to gain access to the lower compartment. In addition to simplifying usage and handling, the maintenance of the separator in securement with the container, precludes undesired intermixing of separators and containers.

Figure 4:
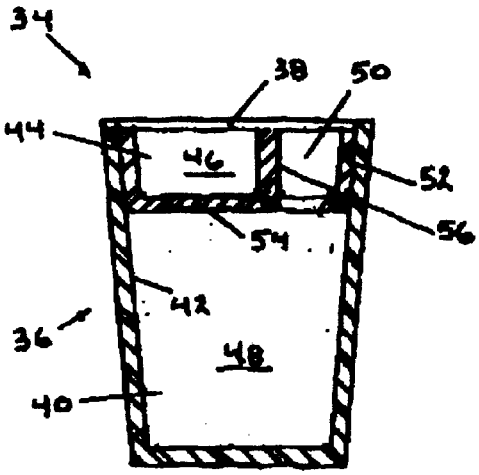
FIG. 4 is sectional elevation of a further version of the first embodiment of the invention.

Turning to FIG. 4, medicine container 34 comprises upstanding body 36 having open mouth 38 and hollow interior 40. Container 34 is comprised of plastic and is of the conventional commercial type widely seen in pharmacies and filled by pharmacists with selected dosages of medicines. In this connection, such conventional commercial type containers are molded plastic members and have interior tapered surface 42, i.e., frustro-conical in configuration, facilitating removal of the container from its forming apparatus.

Separator 44 is seated in body 36 and defines upper and lower compartments, respectively indicated as 46 and 48. Lower compartment 48 is accessible while the separator is seated in body 36, as is upper compartment 46, i.e., by removal of a closure member (not shown). Access to lower compartment 48 is through separator passage 50.

Separator 44 has outer encircling sidewall 52, which is frustro-conical and of the same taper as the uppermost part of body interior tapered surface 42. Separator floor 54 extends between sidewall 52 and separator interior wall 56.

Figure 5:
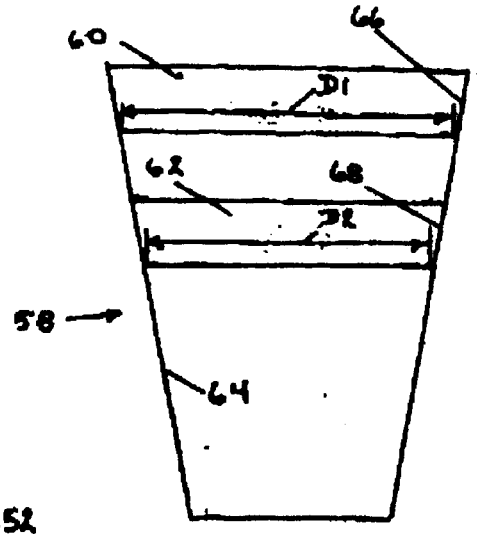
FIGS. 5, 6 and 7 are schematic views explanatory of the FIG. 4 version.
Figure 6:
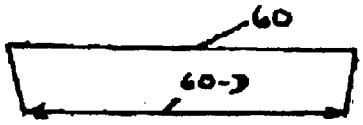

In FIG. 5, applicant depicts schematically, and for purposes of illustration, tapered body 58 with separators 60 and 62 seated at different vertical locations in the body. Applicant's finding thus illustrated is that a separator may be disposed in friction fit with body interior tapered sidewall 64 at any desired vertical location in body 58, without need for an adhesive. Thus, by providing the same taper as body tapered sidewall 64 for the exterior sidewall 66 of separator 60 and a separator lower diameter 60-D (FIG. 6) equal to the diameter D1 of body 58, separator 60 will be disposed as illustrated in FIG. 5.

Figure 7:
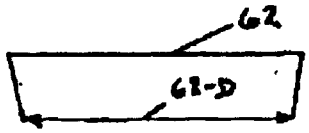

Likewise, by providing the same taper as body tapered sidewall 64 for the exterior sidewall 68 of separator 62 and a separator lower diameter 62-D (FIG. 7) equal to the diameter D2 of body 58, separator 62 will be disposed as illustrated in FIG. 5.

Figure 8:
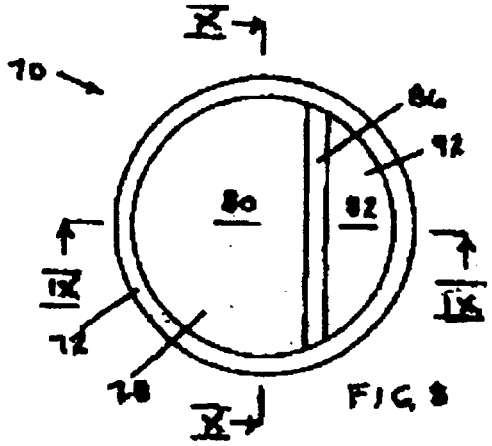
FIG. 8 is a top plan view of a second embodiment of a medication container and dispenser in accordance with the invention.
Figure 10:
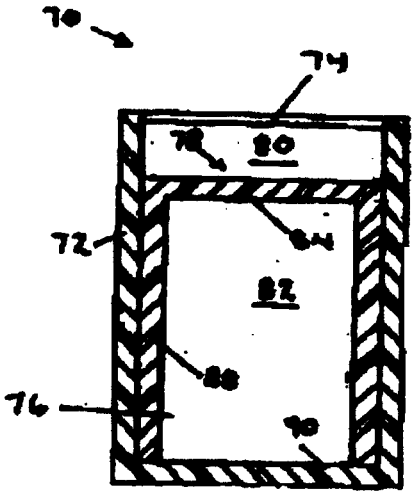
FIG. 10 is a sectional elevation of the FIG. 8 container and dispenser as would be seen from plane X—X of FIG. 8.
Figure 9:
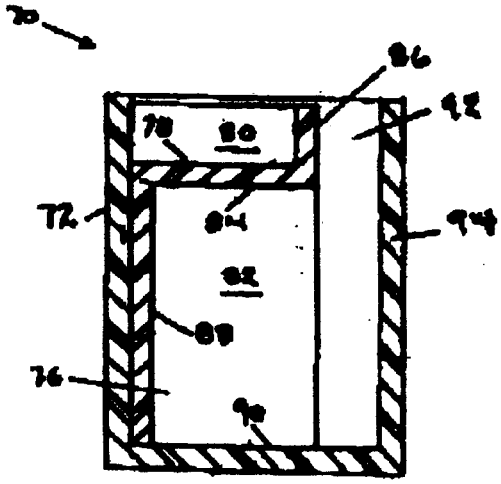
FIG. 9 is a sectional elevation of the FIG. 8 container and dispenser as would be seen from plane IX—IX of FIG. 8.

Referring to FIGS. 8–10, medicine container 70 comprises upstanding body 72 having open mouth 74 and hollow interior 76. Separator 78 is seated in body 72 and defines upper and lower compartments, respectively indicated at 80 and 82.

While body 72 may have various cross-sections, body 72 of FIGS. 8–10 is shown to be circular in cross-section. Separator 78 defines a floor 84 for upper compartment, upper sidewall 86 extending to body mouth 74, and a skirt 88 depending downwardly of floor 84 and perimetrically therewith to bottom panel 90 of body 72. Separator 78 is preferably a molded plastic member, fabricated by vacuum forming.

Passage 92, bounded by separator upper sidewall 86 and body sidewall 94, extends from body mouth 74 into lower compartment 82.

Upper compartment 80 is bounded perimetrically successively by separator upper sidewall 86 and body sidewall 94. Lower compartment 82 is bounded perimetrically successively by separator skirt 88 and body sidewall 94.

Use of container 70 is as above discussed for container 10 of FIGS. 1–3.

Figure 12:
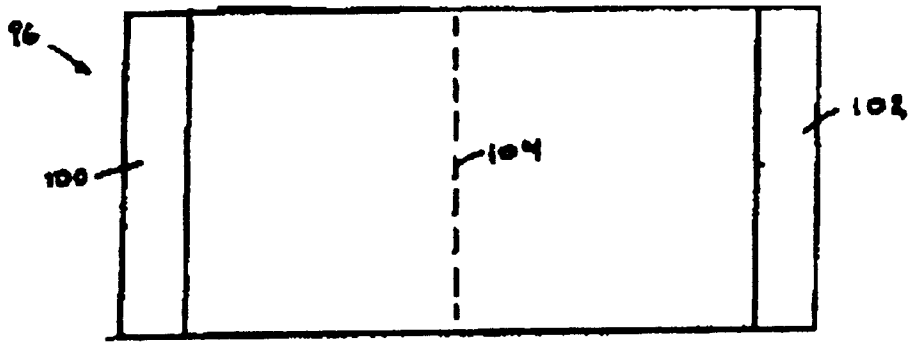
FIG. 12 is a top plan elevation of FIG. 11.
Figure 11:
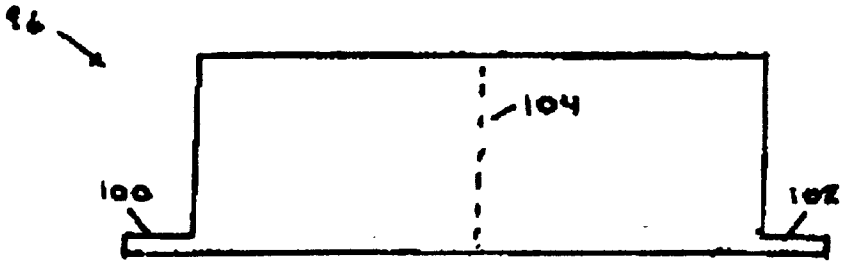
FIG. 11 is a front elevation of an article of manufacture of the invention.
Figure 13:
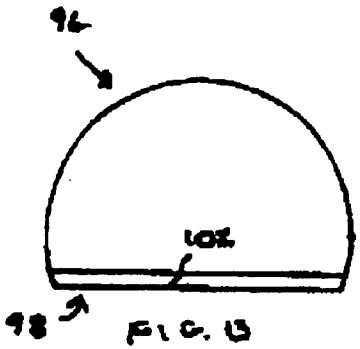
FIG. 13 is a right side elevation of FIG. 11.

Turning to FIGS. 11–13, an article of manufacture 96 is a molded plastic body having a central hollow portion 98 and flat end portions 100 and 102. Once formed, article 96 is cut at cut line 104, providing a pair of separators for use in the container embodiment of FIGS. 8–10. Each half of cut central hollow portion 98 serves as the separator skirt, flat end portions form the separator upper sidewalls and the flat ends of the cut central hollow portions form the respective floors of the upper compartments of the container embodiment of FIGS. 8–10.

Figure 14:
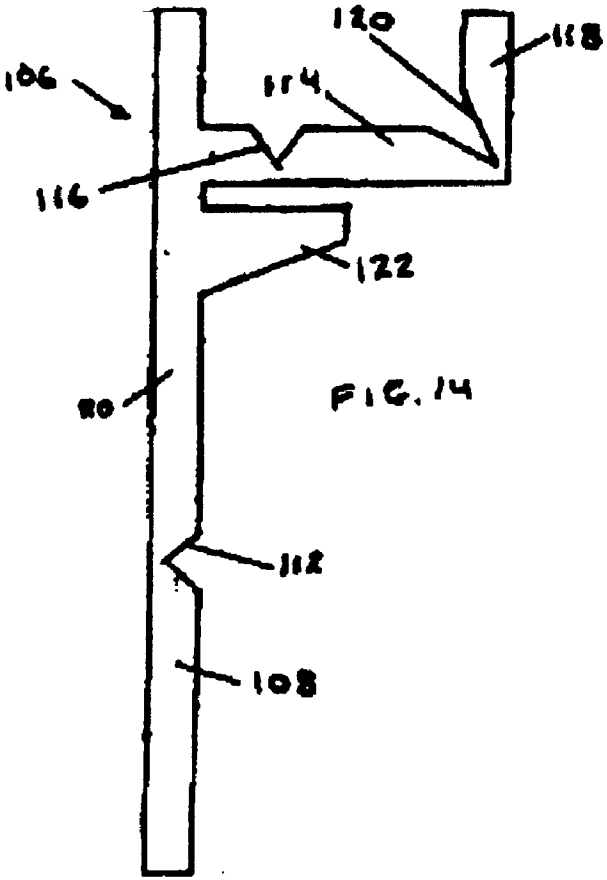
FIG. 14 is a side elevation of an extruded separator in accordance with the invention.

Referring now to FIGS. 14–17, separator 106 of the invention is a plastic extrusion, a side elevation of which is shown in FIG. 14 to comprise a lowermost portion 108, an upright portion 110 contiguous with portion 108 and connected therewith by hinge portion 112. A transverse portion 114 extends from upright portion 110 and is connected therewith by hinge portion 116. Tab portion 118 is contiguous with transverse portion 114 and is connected therewith by hinge portion 120. Further transverse portion 122 extends from upright portion 110 and is spaced below transverse portion 114.

Figure 16:
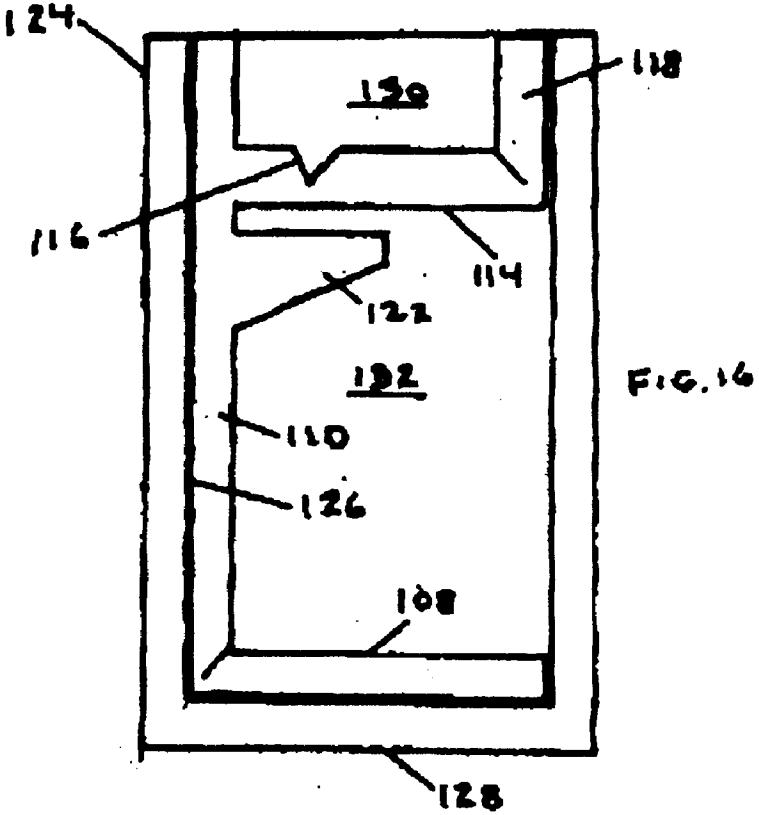
FIG. 16 is a central sectional view of the separator of FIG. 14 in assembly with a medicine dosage container and dispenser, with the separator in its FIG. 15 folded configuration.
Figure 15:
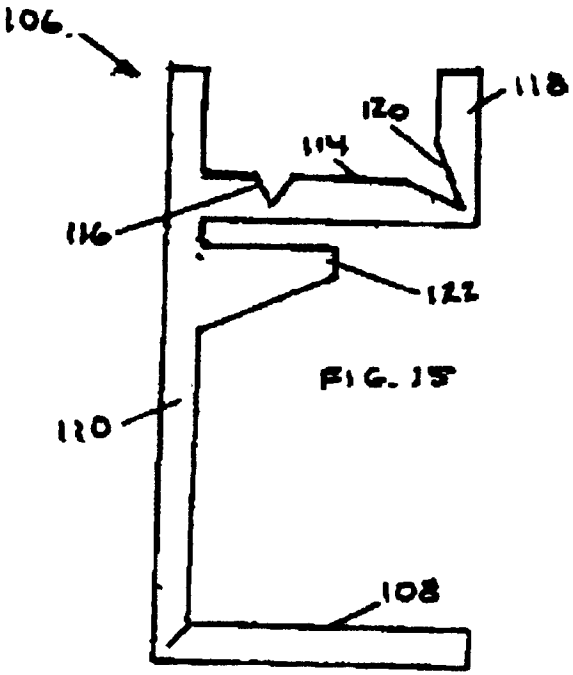
FIG. 15 is a side elevation of the separator of FIG. 14 folded in preparation for its assembly with a medicine dosage container and dispenser.

In FIG. 15, separator is prepared for insertion into a medicine container by arranging lowermost portion 108 perpendicular to upright portion 110. Separator 106 is now inserted into medicine container 124, as is shown in FIG. 16 and is secured either to container sidewall 126 or container bottom 128. Upon such separator insertion, separator defines upper and lower compartments 130 and 132.

Upper compartment 130 is bounded perimetrically successively by separator upright portion 110, container sidewall 126, tab portion 118 and container sidewall 126. Lower compartment 132 is bounded perimetrically successively by separator upright portion 110 and container sidewall 126.

Figure 17:
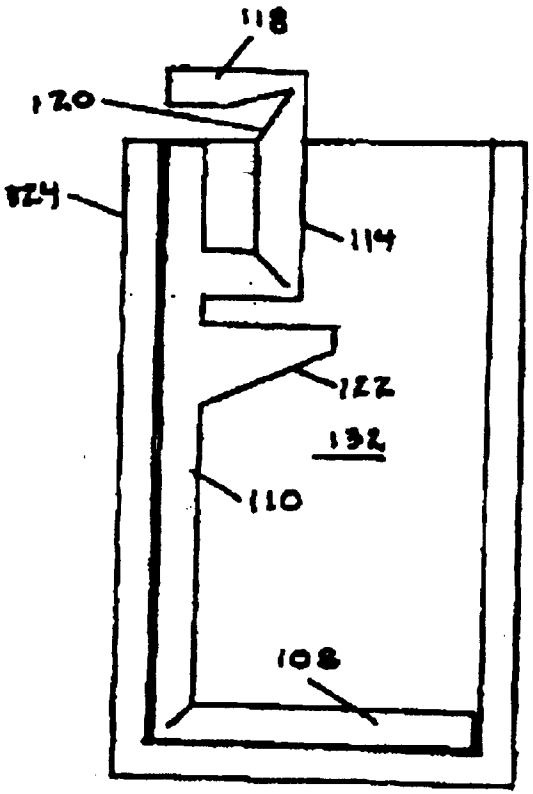
FIG. 17 is a central sectional view of the separator of FIG. 14 in assembly with a medicine dosage container and dispenser, with the separator in a further folded configuration.

Turning now to FIG. 17, tab portion 118 is lifted out of container 124, and transverse portion 114 is pivoted about hinge portion 116 to its illustrated position. On this occurrence, access is afforded to lower compartment 132, while separator 106 remains nonetheless securely seated in container 124. By way of exemplary use, a multiple day supply of medication is now placed in lower compartment 132, tab portion 118 is seated in the container, a one day supply of medication is placed in upper compartment 130 and a container closure member is applied to the container.

Figure 18:
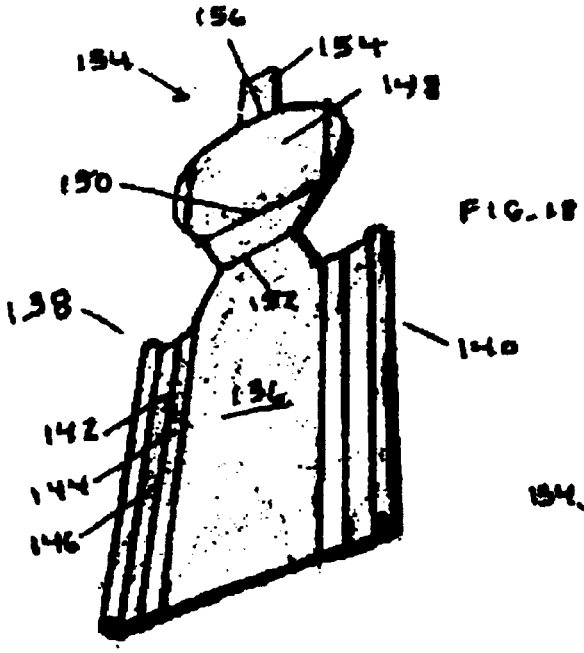
FIG. 18 is a perspective view of another embodiment of a medication container separator in accordance with the invention.
Figure 19:
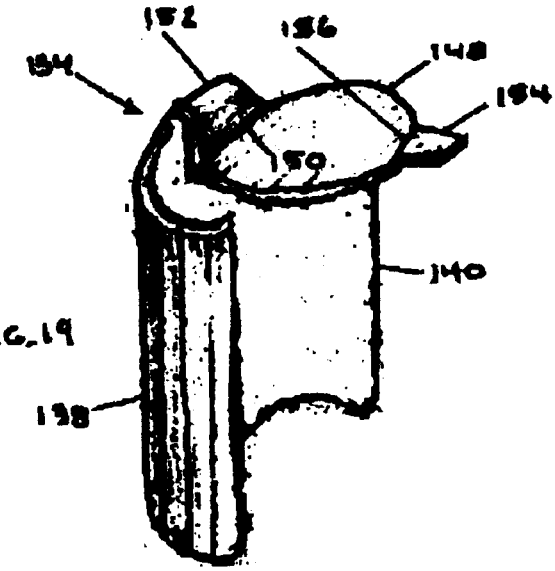
FIG. 19 is further perspective view of the separator of FIG. 18.

Referring now to FIGS. 18 and 19, they depict a further separator 134 in accordance with the invention. In the perspective showing of FIG. 18, separator is seen to comprise a flat extrusion of plastic material having an upright portion 136 having wings 138 and 140. Each wing has ribs, e.g., shown at 142 and 144, with hinge 146 joining the ribs, permitting the wings to be formed into arcuate configuration, as shown in the perspective view of FIG. 19, to conform to the interior curvature of a container (not shown) when separator 134 is inserted therein.

Separator 134 further includes upper portion 148 connected by hinges 150 and 152 to upright portion 136 and has tab 154.

When upper portion 148 is advanced leftwardly from its FIG. 19 disposition, it nests atop wings 138 and 140, defining a floor for an upper compartment and a ceiling for a lower compartment. Separator 134 is then secured interiorly of a container.

A feature common to the foregoing embodiments of the invention is that the separators of the invention are disposed fixedly interiorly of medicine containers and can accordingly bear information relevant to the contained medication, e.g., on the rear surface 156 of separator 134, to be viewable through the container sidewall. Thus, such information as the prescribing physician, the pharmacy providing the medication, the phone number of the pharmacy, dosage information, etc., is protected from ambient environment, unlike the customary label affixed to the exterior of the container, and always remains with the container. Securement of the separator in the container is particularly desired where multiple diverse medications in separate containers are to be administered to a single individual, and interchange of containers and separators is undesired. Where such is not the environment, the invention provides for removability of separators from containers as per the ensuing embodiments.

Referring to FIGS. 20–23, container separator 158 includes a circular bottom part 160 from sides of which extend upright parts 162 and 164 having outwardly extending lips 166 and 168.

Figures 20, 21, 22, 23, 24, 25:
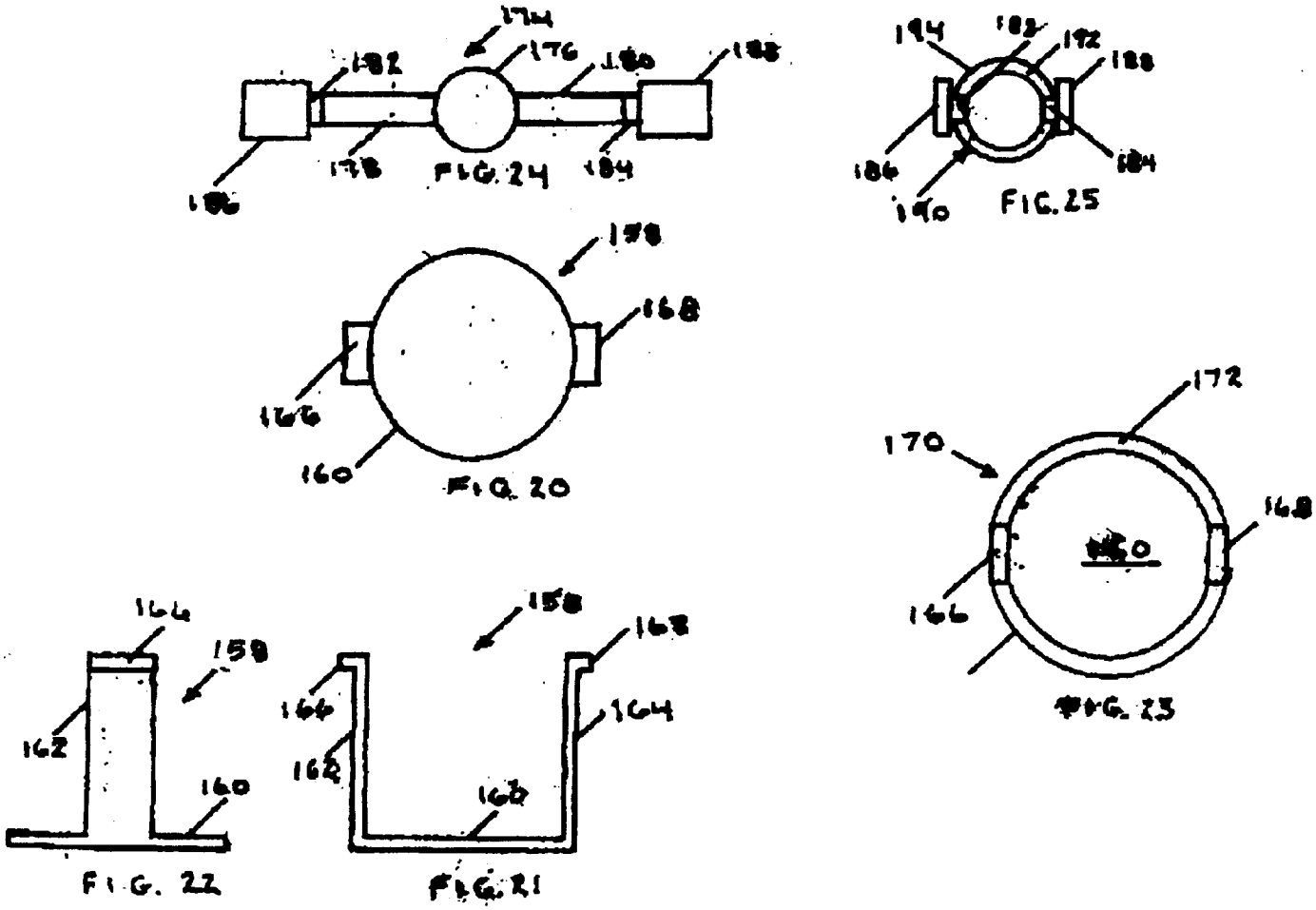
FIG. 20 is a top plan view of another embodiment of a medication container separator in accordance with the invention.
FIG. 21 is a front elevational view of the FIG. 20 separator.
FIG. 22 is a left side elevation of FIG. 19.
FIG. 23 is a top plan view of the FIG. 20 separator in assembly with a medication container.
FIG. 24 is a top plan view of a further embodiment of a medication container separator in accordance with the invention.
FIG. 25 is a top plan view of the FIG. 24 separator in assembly with a medication container.

Separator 158 is shown seated in medicine container 170 in FIG. 23. Separator bottom part 160 is selected to have a diameter slightly less than the diameter of container 170, whereby separator 158 is seatable in an upper portion of an interior hollow (not shown) of container 170, with lips 166 and 168 resting atop lip 172 of container 170.

Separator 158 has sidewalls which are circumferentially discontinuous. Thus, separator 158 uses the interior sidewall bounding the container interior hollow together with upright parts 162 and 164 and separator bottom part 160 to define the isolated upper compartment of the medicine container.

Turning to FIGS. 24 and 25, container separator 174 comprises a flat sheet member, made of plastic, cardboard of like material. In the forming process, such as molding or cutting, a circular part 176 is of diameter slightly less than the interior hollow diameter of a medicine container. Arms 178 and 180 extend outwardly of circular part 176 and have lengths selected to correspond to the desired upper compartment to be provided in the medicine container. Lip parts 182 and 184 extend outwardly of arms 178 and 180 to end parts 186 and 188.

In use of separator 174, arms 178 and 180 are bent upwardly of circular part 176 and separator 174 is inserted into the interior hollow of medicine container 190 (FIG. 25). Lip parts 182 and 184 are then bent to be seatable on container lip 192. End parts 186 and 188 are now bent downwardly to lie against the container outer sidewall.

End parts 186 and 188 will have medicinal dosage or like information imprinted thereon and are of length such that the information is visible following application of a closure member (not shown) to container 190.

Figure 26:
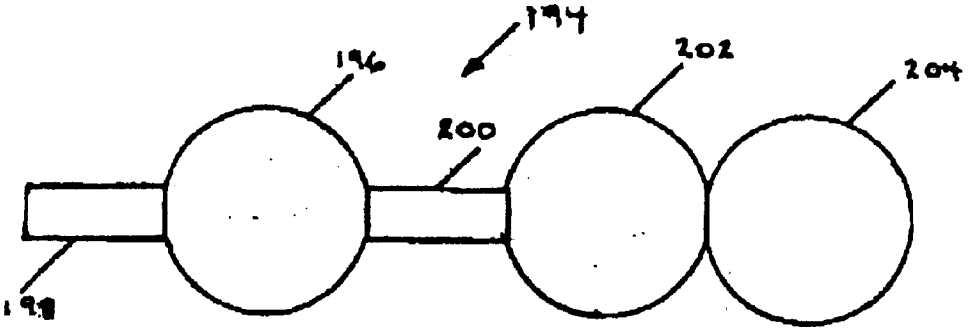
FIG. 26 is a top plan view of a further embodiment of a medication container separator in accordance with the invention.
Figure 28:
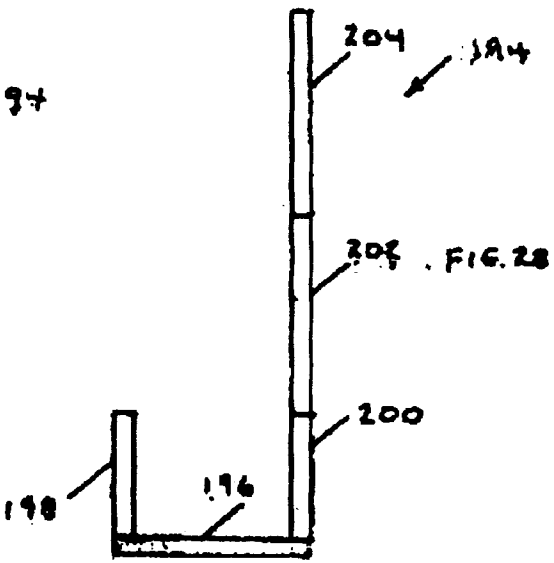
FIG. 28 repeats FIG. 27 with the upper panels of the container separator opened.
Figure 27:
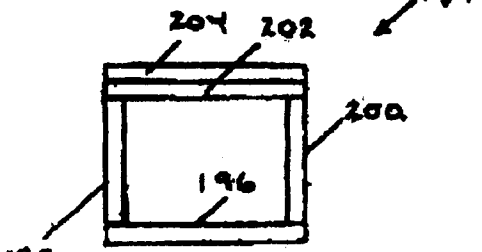
FIG. 27 is a front elevation of the FIG. 26 container separator arranged for insertion in a medication container.

FIGS. 26–28 show a further sheet member type of container separator 194. Here, a sheet member has circular part 196 of diameter slightly less than the diameter of an upper portion of a medicinal container interior hollow. Arm portions 198 and 200 extend outwardly of circular part 196. Circular parts 202 and 204 are formed outwardly of arm portion 200.

In use of separator 194, arm portions 198 and 200 are bent upwardly of circular part 196 and separator 194 is inserted into the upper portion of the interior hollow of a medicine container. Circular part 202 is now folded to lie atop the open separator top and circular part 204 is now folded to lie atop circular part 202, as is depicted in FIG. 27. As is shown in FIG. 28, circular parts 202 and 204 may be unfolded to permit reading of medicinal dosage information on surfaces thereof.

Various changes may be introduced in the disclosed preferred embodiments and practices without departing from the invention. Accordingly, it is to be appreciated that the true spirit and scope of the invention is set forth in the following claims.

What is claimed is:

1. A medicine container, comprising:

(a) an upstanding body having an open mouth and a hollow interior bounded by a sidewall; and (b) a separator secured in said body and defining upper and lower compartments, said upper compartment opening into said body open mouth, said lower compartment being accessible while said separator is secured in said body.

2. The medicine container claimed in claim 1, wherein said separator defines a floor for said upper compartment and a passage opening into said lower compartment.

3. The medicine container claimed in claim 2, wherein said body is circular in cross-section, said separator having an upstanding cylindrical sidewall contiguous with said body sidewall.

4. The medicine container claimed in claim 3, wherein said separator includes an interior sidewall extending upwardly from said separator floor, said upper compartment being D-shaped and bounded by said separator upstanding cylindrical sidewall, said separator floor and said separator interior sidewall.

5. The medicine container claimed in claim 4, wherein said passage opening into said lower compartment extends through said separator floor.

6. The medicine container claimed in claim 1, wherein said separator defines a floor for said upper compartment and a passage opening into said lower compartment, said passage being disposed between said separator and said body sidewall.

7. The medicine container claimed in claim 6, wherein said body is circular in cross-section, said separator having an upstanding cylindrically-shaped sidewall contiguous with a portion of said body sidewall.

8. The medicine container claimed in claim 7, wherein said separator includes an interior sidewall extending upwardly from said separator floor, said upper compartment being D-shaped and bounded by said separator upstanding sidewall, said separator floor and said body sidewall.

9. The medicine container claimed in claim 8, wherein said passage opening into said lower compartment is bounded by said separator upstanding sidewall and said body sidewall.

10. The medicine container claimed in claim 1, wherein said separator has a lowermost portion in spaced facing relation to a floor of said body and an upright portion juxtaposed with said body interior sidewall.

11. The medicine container claimed in claim 10, wherein said separator has a transverse portion extending from said upright portion and separating said upper and lower compartments.

12. The medicine container claimed in claim 11, wherein said separator has a tab portion extending upwardly from a free end of said transverse portion.

13. The medicine container claimed in claim 12, wherein said separator has a further transverse portion extending from said upright portion spacedly below said first-mentioned transverse portion.

14. The medicine container claimed in claim 12, wherein said transverse portion defines a first hinge part spaced from said upright portion.

15. The medicine container claimed in claim 14, wherein said tab portion and said transverse portion jointly define a second hinge part.

16. The medicine container claimed in 15, wherein said lowermost portion and said upright portion jointly define a third hinge part.

17. The medicine container claimed in claim 1, wherein said separator has an upright portion juxtaposed with a portion of said body sidewall.

18. The medicine container claimed in claim 17, wherein said separator has a transverse portion extending from said upright portion and separating said upper and lower compartments.

19. The medicine container claimed in claim 18, wherein said separator has a tab portion extending outwardly from a free end of said transverse portion.

20. The medicine container claimed in claim 19, wherein said separator includes arcuate wings connected with said upright portion, said transverse portion being seated atop said arcuate wings.

21. A medicine container comprising:

(a) an upstanding body having an open mouth and a hollow interior bounded by a sidewall; and (b) a separator seated in said body and defining upper and lower compartments, a perimeter of said upper compartment being formed successively by said body sidewall and said separator.

22. A medicine container, comprising:

(a) an upstanding body having an open mouth and a hollow interior, said body defining an interior tapered surface bounding said hollow interior; and (b) a separator seated in said body and defining upper and lower compartments, said separator having an exterior tapered sidewall having the same taper angle as said body interior surface.

23. A medicine container, comprising:

(a) an upstanding body having an open mouth and a hollow interior bounded by a sidewall; and (b) a separator seated in said body and defining upper and lower compartments, said upper compartment opening into said body open mouth, said separator having an upright portion juxtaposed with said body interior sidewall, a transverse portion extending from said upright portion and constituting both a floor for said upper compartment and a ceiling for said lower compartment, and a tab portion extending upwardly from a free end of said transverse portion, said transverse portion being pivotable relative to said upright portion to provide access to said lower compartment.

24. The medicine container claimed in claim 23, wherein said transverse portion defines a first hinge part for providing pivoting of said transverse portion relative to said upright portion.

25. The medicine container claimed in claim 24, wherein said tab portion and said transverse portion jointly define a second hinge part providing for pivoting of said tab portion relative to said transverse portion.

26. The medicine container claimed in claim 23, wherein said separator includes arcuate wings connected with said upright portion, said transverse portion being seated atop said arcuate wings.

* * * * *

UNITED STATES PATENT AND TRADEMARK OFFICE

CERTIFICATE OF CORRECTION

PATENT NO. : 6,769,570 B2
DATED : August 3, 2004
INVENTOR(S) : Logan

It is certified that error appears in the above-identified patent and that said Letters Patent is hereby corrected as shown below:

Column 10,
Lines 18-24, delete and insert the following:

22. A medicine container comprising:

(a) an upstanding body having an open mouth and a hollow interior, said body defining an interior tapered surface bounding said hollow interior; and (b) a separator seated in said body and defining upper and lower compartments, said separator having an exterior tapered sidewall having the same taper angle as said body interior surface, said lower compartment being accessible while said separator is secured within said body.

Signed and Sealed this

Sixth Day of September, 2005

JON W. DUDAS
*Director of the United States Patent and Trademark Office*